US006582209B2

(12) United States Patent
Rodriguez-Amaya

(10) Patent No.: US 6,582,209 B2
(45) Date of Patent: Jun. 24, 2003

(54) FUEL INJECTION SYSTEM FOR INTERNAL COMBUSTION ENGINES

(75) Inventor: Nestor Rodriguez-Amaya, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/931,056

(22) Filed: Aug. 17, 2001

(65) Prior Publication Data

US 2002/0073966 A1 Jun. 20, 2002

(30) Foreign Application Priority Data

Aug. 18, 2000 (DE) ..... 100 40 522

(51) Int. Cl.[7] ..... F04B 39/08; F04B 23/00; F04B 49/00

(52) U.S. Cl. ..... 417/505; 417/441; 417/297; 123/467

(58) Field of Search ..... 417/505, 441, 417/297; 123/467; 239/533.2, 533.9, 585.4, 585.5

(56) References Cited

U.S. PATENT DOCUMENTS 4,453,896 A * 6/1984 Vilardo et al. ..... 417/462
5,524,826 A * 6/1996 Mueller et al. ..... 239/88
5,937,909 A * 8/1999 Clauss et al. ..... 138/43
5,954,487 A * 9/1999 Straub et al. ..... 417/505

* cited by examiner

*Primary Examiner*—Timothy P. Solak
(74) *Attorney, Agent, or Firm*—Ronald E. Greigg

(57) ABSTRACT

A fuel injection system for internal combustion engines essentially has a high-pressure injection pump, supplied with fuel from a low-pressure region, and a magnetic piston valve serving to control the injection pump. The magnetic valve having two coaxial valve chambers, communicating with one another through a valve opening but separable from one another by a valve seat, and an armature chamber. The armature chamber communicates with the inlet side via a pressure conduit, and the low-pressure valve chamber communicates with the outlet region of the injection pump. The low-pressure valve chamber has a fuel inlet conduit and a fuel outlet conduit, both of which have a gradually tapered cross section compared to the cross section of the remaining regions of the fuel inlet conduit and fuel outlet conduit. Maximal prevention of cavitation is successfully achieved in the region of the low-pressure valve chamber and hence cavitation erosion that is possible as a consequence of cavitation.

2 Claims, 1 Drawing Sheet

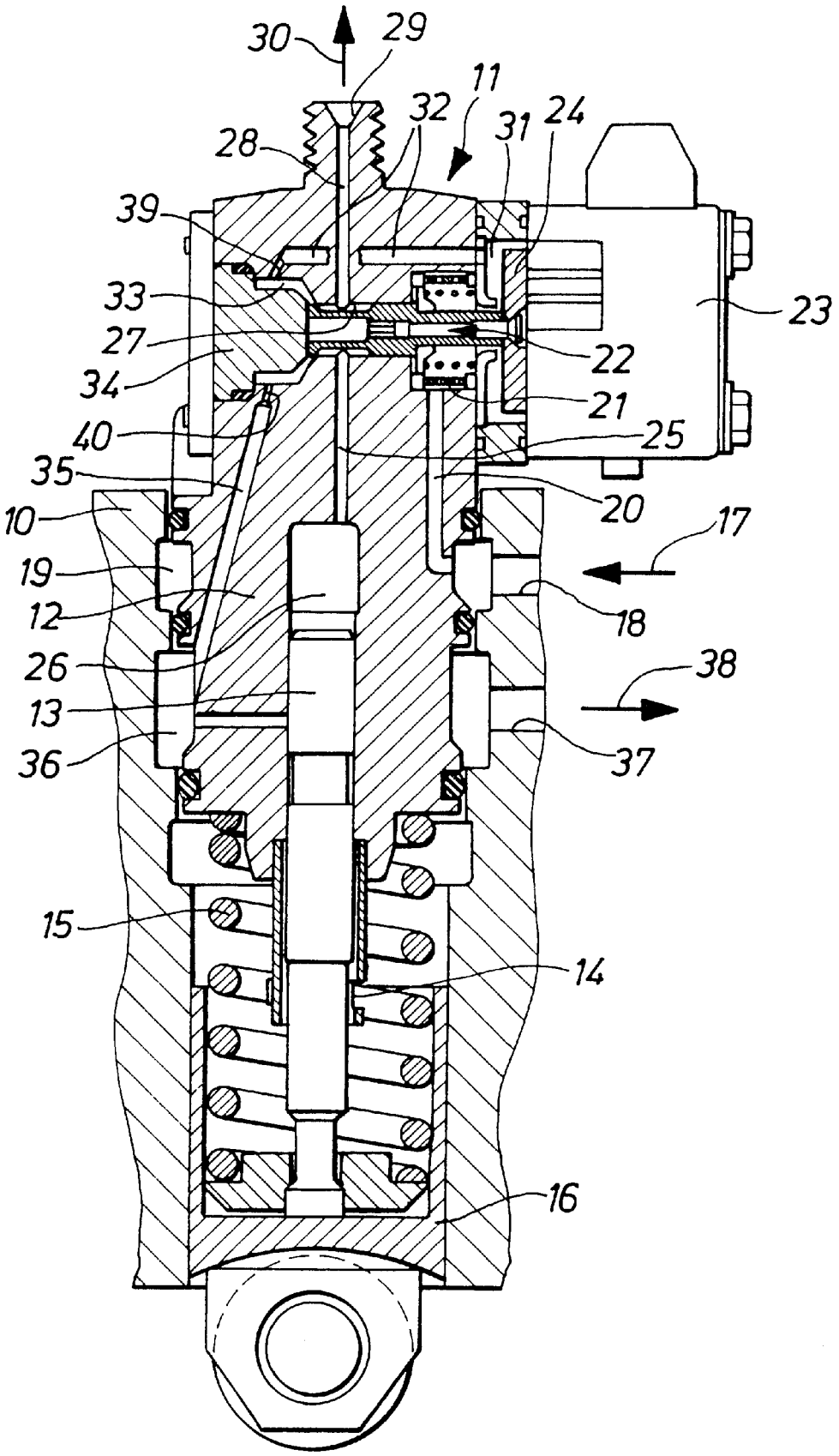
30
29
11
32
31
24
28
39
33
27
34
40
35
10
19
12
26
13
36
15
16
14
37
38
17
18
20
25
21
22
23

FUEL INJECTION SYSTEM FOR INTERNAL COMBUSTION ENGINES

BACKGROUND OF THE INVENTION

1. Field of the Invention

The invention relates to a fuel injection system for internal combustion engines and having a high-pressure pump supplied with fuel from a low-pressure source.

2. Description of the Prior Art

The field of use of the invention—unlike fuel injection systems of the distributor type—is unit fuel injector injection systems (so-called UISs) and pump-line-nozzle injection systems (so-called UPSs). In such injection systems, in the region of the magnet valve seat, because of the fuel inlet conduit and outlet conduits discharging there, or in other words because of the greatly reduced liquid pressure in these conduits, cavitation erosion can occur. The (unwanted) consequence can be a shortened service life of the affected UIS or UPS injector.

The object of the invention is to avoid cavitation erosion in the region of the magnet valve seat.

SUMMARY OF THE INVENTION

Because of the reduction in cross section of the fuel inlet and outlet bores effected by graduation in the direction of the low-pressure valve chamber, a slight throttling of the fuel flow in these conduits is attained. The consequence is a corresponding increase in pressure, which reduces or entirely prevents the development of cavitation bubbles. The later implosion of cavitation bubbles could cause cavitation erosion damage at the valve seat (needle and/or body) in the low-pressure valve chamber or in the fuel inlet and outlet bores. Such damage is thus avoided by the cross-sectional reductions, graduated according to the invention, in the applicable conduits.

BRIEF DESCRIPTION OF THE DRAWINGS

The invention is described herein below with reference an exemplary embodiment illustrated in the single drawing which is a vertical longitudinal section of one embodiment of a fuel injection system of the UPS type (that is, pump-line-nozzle injection system).

DESCRIPTION OF THE PREFERRED EMBODIMENT

Reference numeral 10 designates the cylinder block of an internal combustion engine, with which the fuel injection system, identified overall by reference numeral 11, is integrated. In a pump body 12 of the injection system, an injection piston 13 is retained in a receptacle 14 and disposed (vertically) movably counter to the resistance of a compression spring 15. The motion is effected by the contact of a tappet 16 with a cam (not shown).

The fuel supplied to the pump body 12 is effected—in the direction of the arrow 17—by a supply line 18 in the cylinder block 10, which line discharges into an annular conduit 19. From there, the delivered fuel passes through a conduit 20 via a filter 21 into an armature chamber 31 and on through an inlet conduit 32 into a low-pressure chamber 33 of a magnet control valve identified overall by reference numeral 22. An electromagnet that actuates the control valve 22 is marked 23, and its armature is marked 24.

Otherwise, such a magnet control valve and its mode of operation are part of the known prior art, and so a detailed description of them can be dispensed with here.

The fuel flow, controlled and monitored by the magnet control valve 22, passes through the valve seat cross section and a pressure conduit 25 into a pump pressure chamber 26. If the injection piston 13 now executes a vertical upward motion, then the fuel located in the pump pressure chamber 26 is forced through the pressure bore 25 via an annular chamber or pressure chamber 27 into a further pressure bore 28, from which finally it reaches the open air at 29, or the combustion chamber of a cylinder (not shown) of the applicable engine, via an injection line (not shown) and injection nozzle (also not shown), in the direction of the arrow 30.

The proportion of fuel not needed for injection into the cylinder of the engine passes out of the high-pressure chamber 27 of the magnet control valve 22 via the valve seat cross section to reach the low-pressure valve chamber 33. By means of a graduated insert 34 that determines or defines the volume of the low-pressure valve chamber 33, the low-pressure valve chamber 33 is given an annular-cylindrical form.

From the low-pressure valve chamber 33, the unneeded fuel is diverted through a fuel outlet conduit 35 into an annular chamber 36, from which—through an outlet line 37 in the cylinder block 10, it is diverted back—in the direction of the arrow 38—into the low-pressure chamber (not shown) of the engine.

The special feature of the fuel injection system shown and described above is that the portions of the fuel supply line conduit 32 and the fuel outlet line conduit 35—which portions are indicated in the drawing by reference numerals 39 and 40, respectively—that discharge into the low-pressure valve chamber 33 or are immediately adjacent to it have a reduced cross section, compared to the cross section of the remaining regions of the conduits 32, 35.

The drawing makes it clear that this involves graduated cross-sectional transitions in each case. By means of the cross-sectional reduction in question in the portions 39, 40 immediately adjoining the low-pressure valve chamber 33, a corresponding throttling of the fuel pumped into the fuel inlet conduit 32 and fuel outlet conduit 35 is accomplished, associated with a slight increase of pressure in the low-pressure valve chamber 33, as a result of which the tendency to cavitation in the region of the low-pressure valve chamber 33 can be reduced substantially or precluded entirely. Cavitation erosion damage in these regions can thus be effectively prevented.

In this respect, it is also advantageous if the volume of the low-pressure valve chamber 33 is made as large as possible.

The foregoing relates to preferred exemplary embodiment of the invention, it being understood that other variants and embodiments thereof are possible within the spirit and scope of the invention, the latter being defined by the appended claims.

I claim:

1. A fuel injection system for internal combustion engines, having a high-pressure injection pump (11) with an inlet side and an outlet side, supplied with fuel from a low-pressure region, and having a magnet valve (22) serving to control the injection pump (11), which magnet valve is positioned in a valve housing and has two valve chambers (27, 33), located coaxially to one another and communicating with one another through a valve opening, but are separable from one another by a valve seat, and one armature chamber (31), wherein the armature chamber (31) communicates via a pressure conduit (20) with the inlet side of the injection pump, and the valve chamber (33) communicates with a low-pressure region of the injection pump (11), and wherein the valve chamber (33) has a fuel inlet conduit (32) and a fuel outlet conduit (35) in communication therewith, characterized in that each of the fuel inlet conduit (32) and the fuel outlet conduit (35), in the portions immediately adjoining the valve chamber (33), have a tapered cross section compared to the cross section of the remaining regions of the fuel inlet conduit and fuel outlet conduit.

2. The fuel injection system of claim 1, wherein a respective single-stage cross section tapering (39 and 40) of the fuel inlet conduit and fuel outlet conduit (32 and 35, respectively) is provided.

* * * * *